US005476054A

United States Patent [19]

Dériaz

[11] Patent Number: 5,476,054

[45] Date of Patent: Dec. 19, 1995

[54] HULL FOR WATERCRAFT

[76] Inventor: Marc Dériaz, Raingassli 48, 8706 Meilen, Switzerland

[21] Appl. No.: 350,067

[22] Filed: Nov. 29, 1994

(Under 37 CFR 1.47)

[30] Foreign Application Priority Data

Dec. 15, 1993 [CH] Switzerland ..... 3756/93

[51] Int. Cl.[6] ..... B63B 35/00

[52] U.S. Cl. ..... 114/39; 114/56

[58] Field of Search ..... 114/56, 39.1, 39.2, 114/271, 288; D12/300–303

[56] References Cited

U.S. PATENT DOCUMENTS

| | | | |
|---|---|---|---|
| D. 113,668 | 3/1939 | Higgins | 114/288 |
| 2,444,526 | 7/1948 | Pawley Jr. | 114/39.1 |
| 2,634,436 | 4/1953 | Plaziak | 114/271 |
| 3,088,428 | 5/1963 | Majnoni | 114/39.1 |
| 3,369,512 | 2/1968 | Music | 114/56 |
| 3,656,445 | 4/1972 | Padwick | 114/39.1 |
| 5,394,819 | 3/1995 | Aarnio | 114/56 |

*Primary Examiner*—Edwin L. Swinehart
*Attorney, Agent, or Firm*—Laurence R. Brown

[57] ABSTRACT

In order to attain a superior performance of a sailboat (1) under different conditions, e.g., dead calm, average winds, high waves, etc., the invention makes possible that the two longitudinal sides of the hull essentially correspond with the gliding surfaces (11,12) of surfboards. These gliding surfaces are arranged in the shape of a V, may contact one another within the central region (T) of the watercraft (1) and transform into a transition area that forms the bow within the front region by providing additional side walls (15,16).

8 Claims, 4 Drawing Sheets

(I-I)

(II-II)

(III - III)

HULL FOR WATERCRAFT

The present invention pertains to a hull for watercraft as well as single-hull sailboats.

With different types of watercraft, e.g., sailboats, motorboats, etc., it is important that the watercraft perform well in the water under different conditions.

U.S. Pat. Nos. 5,125,352 and 5,038,696 describe motorboats that suggest solutions to the aforementioned objective. European Patent No. 0,298,050 suggests a hull for a sailboat that is designed as a solution to the aforementioned objective.

The solutions disclosed in the three aforementioned patents in particular are characterized by the following properties:

Superior performance is attained in high waves due to the fact that only one bow is provided.

Superior stability against rolling is attained due to the fact that two lowered stern sections are provided.

The suggested hulls have less resistance while gliding through the water slowly due to little whirling in the stern region.

At high speeds, the suggested hulls have a reduced wet surface.

The disadvantage of the three suggested solutions can be in seen in the fact that the side walls of the hulls have a very steep inclination, whereby the solutions suggested in both aforementioned U.S. patents are only suitable for motorboats. The solution suggested in European Patent Application No. 0,298,050 is not very advantageous in average to high winds, i.e., at high speeds, due to its very voluminous and bulging hull. This in particular is caused by the lateral surfaces which extend almost perpendicular to the water surface.

U.S. Pat. No. 4,907,518 suggests a multi-hull sailboat or a so-called catamaran. Although catamarans perform in superior fashion, they are relatively dangerous in high waves since the two hulls which lie on the waves cause an irregular, forceful rolling motion in the longitudinal axis, i.e., the boat may easily tilt or capsize.

The present invention is based on the objective to suggest a watercraft or a hull for a watercraft which, particularly if used in a sailboat, makes possible a simple and uncomplicated operation of the boat by the crew under different circumstances and is characterized by a superior performance under different conditions.

The hull according to the invention is characterized by two side walls, each of which corresponds to the gliding surface of a surfboard along a substantial region or a major portion, whereby both gliding surfaces are arranged in the shape of a V, at least nearly touch one another within the central region of the watercraft and transform into a transition area that forms the bow within the front region of the watercraft by providing additional side walls.

The hull according to the invention is particularly suitable for sailboats, but may also be used for the manufacture of rowboats, motorboats or any other type of watercraft.

The advantages of a sailboat which is manufactured with a hull according to the invention can be seen from the fact that the crew is easily able to maintain the boat in a flat and horizontal position in gentle winds. The water lines are similar to the ones of a conventional single-hull sailboat, with the exception of the stern region, where the stern consists of two ends with a smaller wet surface instead of one wide and flat stern with a large wet surface that causes more resistance, as is the case with conventional sailboats. Under average wind conditions in which the wind force suffices for causing a gliding movement of the boat, the crew tilts the boat such that the boat glides on the surfboard-like gliding surface situated opposite to the crew. In this tilted position of the boat, the lever arm caused by the crew leaning over the edge of the boat situated on the side opposite to the surfboard-like gliding surface is increased substantially as compared to the lever arm which exists while the boat is situated in horizontal position, whereby said fact represents one prerequisite while gliding through the water with a conventional sailboat with a wide and flat stern. With an identical weight of the crew, this measure counteracts the capsizing of the boat in a more efficient fashion.

The invention is described in detail below with reference to the enclosed figures. The figures show:

DESCRIPTION OF THE PREFERRED EMBODIMENT(S)

Figure 1:
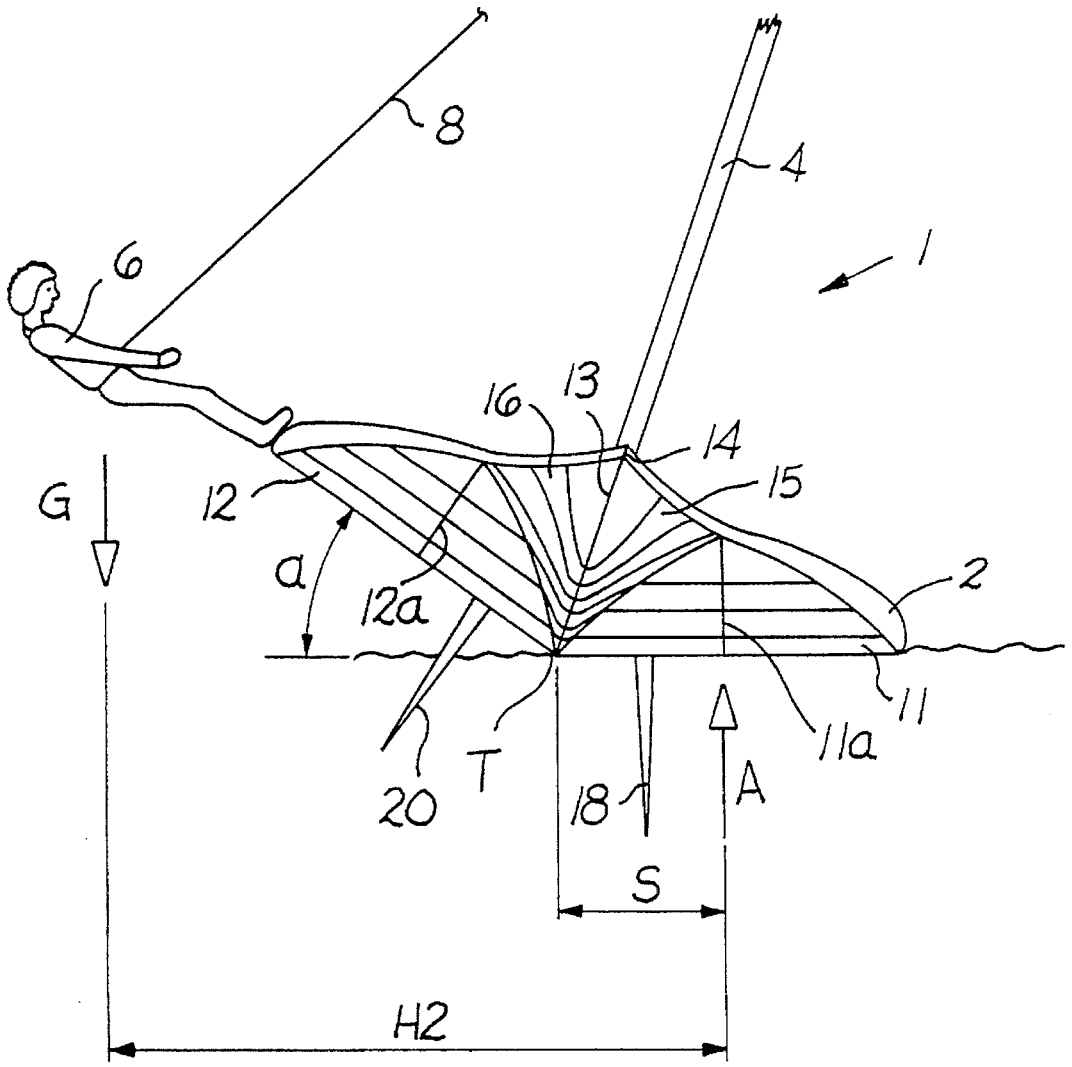
FIG. 1: a front view of a sailboat in the gliding position with a hull that is constructed according to the invention.

FIG. 1 shows a front view of a sailboat 1 which is provided with a hull 2 according to the invention. The illustration of the mast 4 is intended to indicate that this figure pertains to a sailboat although the sail was omitted for reasons of clarity. One crew member 6 of the crew operating the sailboat is leaning against the wind over the edge of the sailboat while hanging from the line 8 in order to maintain the sailboat in the tilted position illustrated in the figure while gliding through the water.

Figure 2:
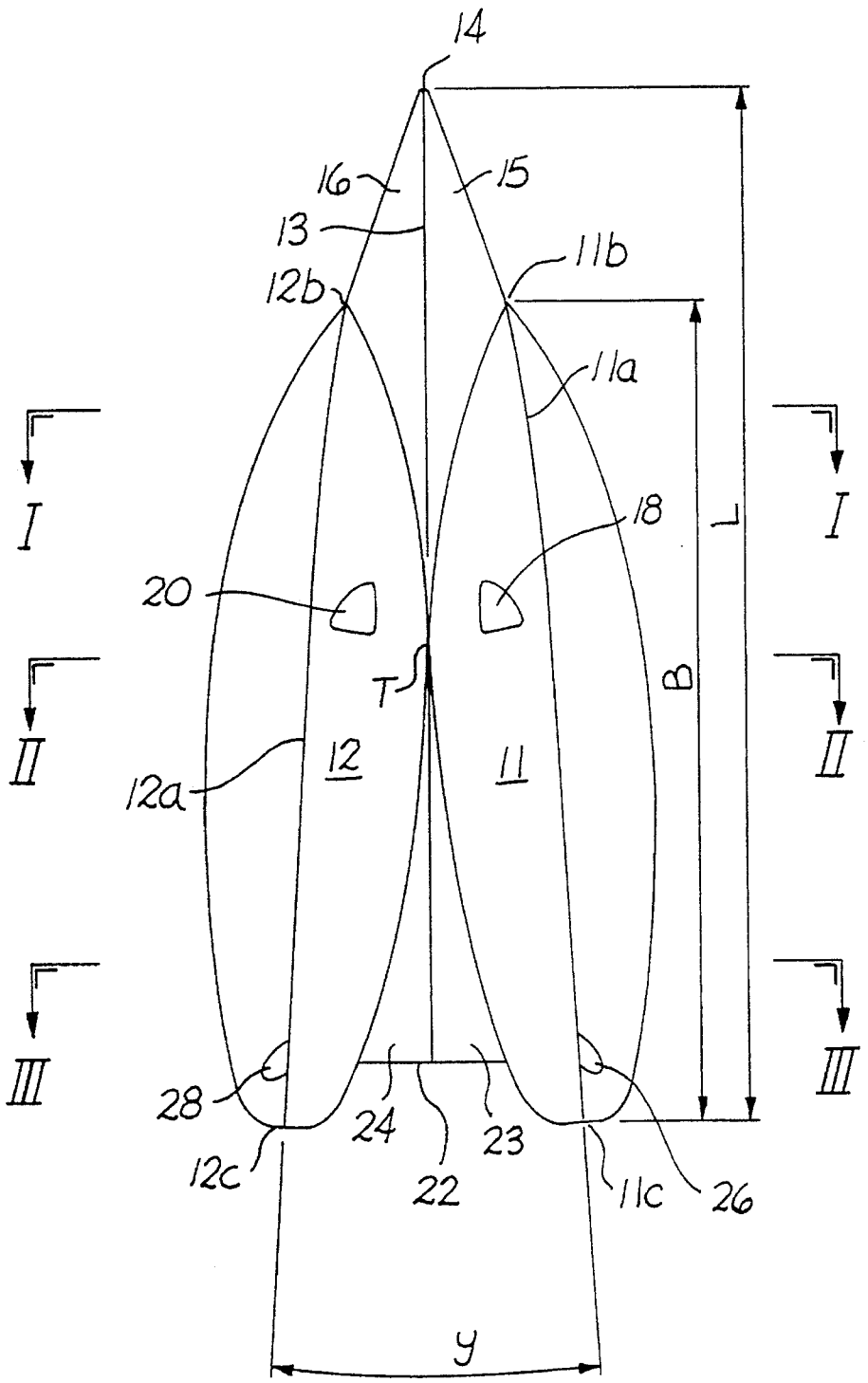
FIG. 2: a bottom view of the hull of the sailboat shown in FIG. 1.

According to the invention, the hull 2 of the sailboat comprises two side wall regions 11 and 12 which correspond to the gliding surfaces of surfboards, touch one another within the central region T of the sailboat as shown in FIG. 2, and are arranged in the shape of a V. The incline between the two gliding surfaces is illustrated by the angle a which, according to the invention, should be between 20° and 50° preferably between 26° and 48°. Within the front region of the sailboat, the two surfboard-like gliding surfaces 11 and 12 are connected to one another via the two lateral surfaces 15 and 16 which end in one common bow 14. At their lower side, the two surfaces 15 and 16 form the longitudinal keel 13 of the sailboat 1.

One leeboard 18 and 20 is arranged within the central region of the gliding surfaces 11 and 12, respectively, i.e., within the region of the contact point T (see FIG. 2). These leeboards preferably are arranged between the two central longitudinal axes 11*a* and 12*a* of the two surfboard-like gliding surfaces 11 and 12 and the central longitudinal keel 13 of the sailboat 1. The leeboards 18 and 20 approximately correspond to conventional leeboards as they are used in ordinary surfboards. The region in which these leeboards preferably are arranged is identified by the reference symbol S in FIG. 1.

One important advantage of the design of the sailboat hull 2 is shown in FIG. 1. This advantage consists of the fact that, in the tilted position of the sailboat 1 shown in the figure, the crew member leaning from the edge of the sailboat may apply a higher force with his own weight G for maintaining the sailboat in the position shown since his own weight G engages with the gliding surface 11 of the sailboat 1, namely within the region 11*a*, with the gliding-lifting force A via a relatively large lever arm H2. In conventional gliding sailboats, this lever arm is substantially smaller due to the fact that the lever arm effect largely occurs within the central keel region of the sailboat.

FIG. 2 shows a bottom view of the sailboat illustrated in FIG. 1, whereby both surfboard-like gliding surfaces 11 and 12 are clearly visible. These surfboard-like gliding surfaces 11 and 12 may have different shapes, i.e., similar to the different shapes which are known in the manufacture of practical surfboards. In the hull illustrated in this figure, both surfboard-like gliding surfaces 11 and 12 form one respective tip 11*b* or 12*b* which also may be rounded. This figure also shows the front connection that forms both lateral surfaces 15 and 16, which in turn together form the bow 14 of the sailboat. FIG. 2 clearly shows the contact point or contact region T between both surfboard-like gliding surfaces 11 and 12. The length of the surfboard-like gliding surfaces 11 and 12 is identified by the reference symbol B, while the total length of the sailboat is identified by the reference symbol L. In practical applications, it was established that it is advantageous if the ratio between B and L is approximately 70–90%, preferably 75–87%.

It is preferred that both central longitudinal axes 11*a* and 12*a* do not extend parallel to one another, but rather apart from one another viewed from the tip 14 of the boat at a divergence angle y of approximately 0°–10°, preferably 3°–9°.

Within the stern region of the sailboat, the two surfboard-like gliding surfaces 11 and 12 are connected to one another centrally via surfaces 23 and 24, whereby said surfaces 23 and 24 are designed in such a way that they extend upward, i.e., away from the water, in the shape of an arc or a V, such that a free space is formed between the hull of the sailboat and the water surface. The connecting surface 23/24 is limited at the stern side by one end surface 22, whereby said end surface 22 preferably is offset toward the boat against both stern sections 11*c* and 12*c* of the two surfboard-like gliding surfaces 11 and 12. The distance between the end surface 22 and the two stern sections 11*c* and 12*c* is approximately 2–15% of the total length of the boat, preferably between 6–10%.

This figure also shows that two leeboards 18 and 20 as well as the two rudders 26 and 28 arranged in the stern region are situated on the lower side of the two surfboard-like gliding surfaces 11 and 12.

Figure 3:
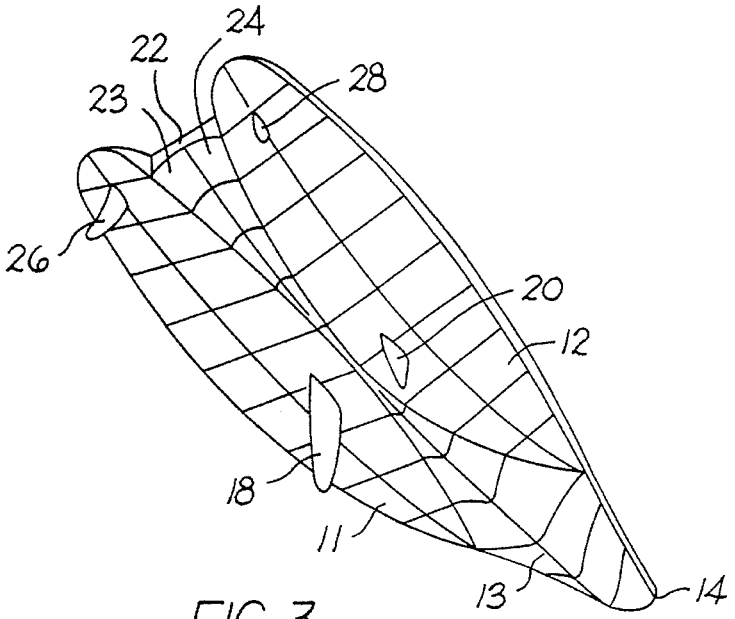
FIG. 3: a perspective representation of a bottom view of the hull shown in FIG. 1.

FIG. 3 again shows a bottom view of the hull, but in a perspective representation, so as to illustrate the arc-shaped connection between both surfboard-like gliding surfaces 11 and 12 within the stern region.

Figure 4:
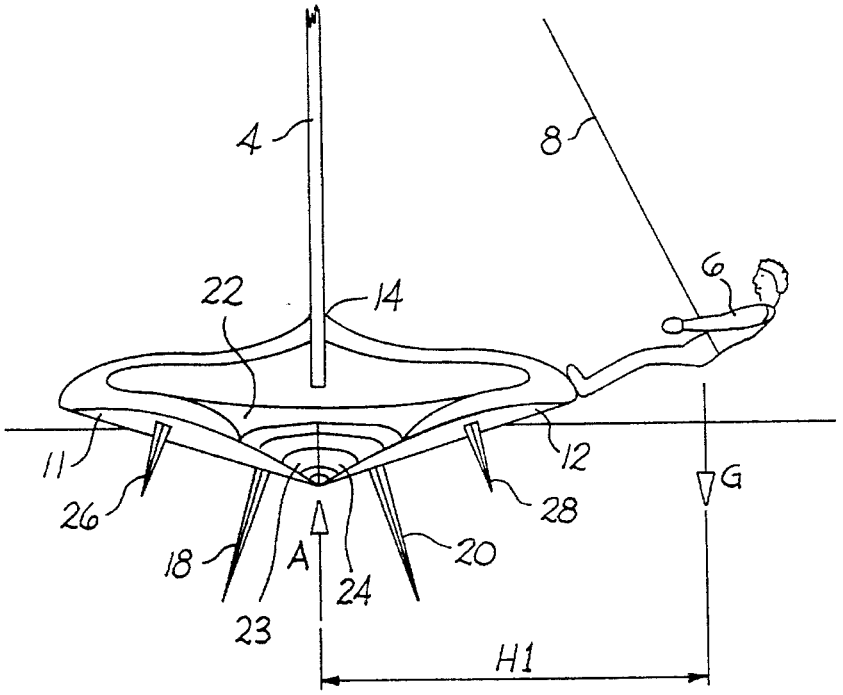
FIG. 4: a rear view of the sailboat shown in FIG. 1 in the position which results during gentle winds.

FIG. 4 shows a rear view of the sailboat illustrated in FIG. 1, whereby the sailboat again is identified by the illustration of a mast 4 although the sail is omitted. The sailboat according to FIG. 4 is maintained approximately in the horizontal position by one crew member 6 in order to attain the conventional water lines of a conventional single-hull sailboat in gentle winds. However, this also shortens the lever arm H1 due to the fact that said lever arm only engages in the central keel region 13 of the boat. Consequently, the lever arm approximately corresponds to that which is attained in conventional sailboats.

Figure 5:
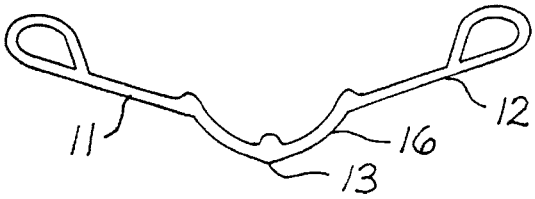
FIG. 5: cross section along line I—I of FIG. 2.
Figure 6:
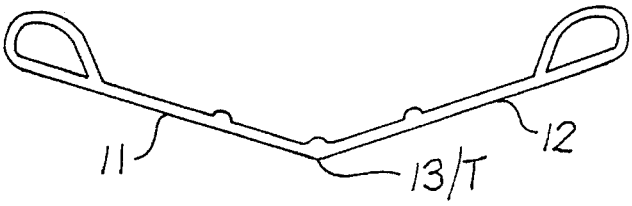
FIG. 6: cross section along line II—II of FIG. 2.
Figure 7:
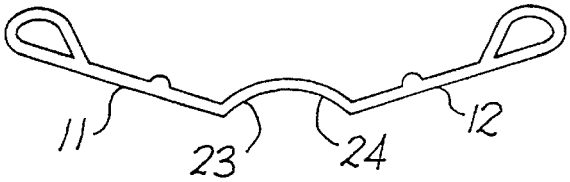
FIG. 7: cross section along line III—III of FIG. 2.

FIGS. 5 through 7 show three different cross sections of the hull illustrated in FIG. 2, whereby FIG. 5 shows a cross section along line I—I. This figure clearly shows the lateral connecting surfaces 15 and 16 between the two surfboard-like gliding surfaces 11 and 12 that contact one another within the central region of the keel 13.

In FIG. 6, the two surfboard-like gliding surfaces 11 and 12 contact one another at the central keel 13 within the region T.

However, it is also possible that the two surfboard-like gliding surfaces do not touch one another, but rather are situated at a distance from one another within the so-called proximity region.

In FIG. 7, the two surfboard-like gliding surfaces 11 and 12 are connected to one another within the stern region via the arc-shaped or V-shaped connecting surface 23 or 24, respectively, such that a free space is formed underneath this connecting surface and above the water level (not shown in the figures) and the wet surface within the stern region may be reduced substantially. This results in less whirling within the stern region.

It goes without saying that the sailboat or the hull according to the invention which is illustrated in FIGS. 1 through 7 only represents an example which may be modified, varied or supplemented by additional elements in any arbitrary fashion. The surfboard-like sliding surfaces in particular may be designed differently. The design of the gliding surfaces need not correspond to the design of conventional surfboards which is attained by using a foamed plastic, i.e., by means of a relatively voluminous body. Rather, the cross section above the surfboard-like gliding surfaces 11 and 12 may correspond to the hull of a conventional sailboat. Regarding the materials used for the manufacture of the hull, any construction materials which are used for the manufacture of conventional sailboats, motorboats, rowboats, surfboards, etc., may be considered.

I claim:

1. A watercraft, comprising in combination:

two gliding surfaces for gliding over a water surface arranged in a V-shaped array on either side of a longitudinal keel line, each gliding surface having a longitudinal axis and being configured to support the watercraft for gliding on the water surface substantially by the sole support of a single one of the gliding surfaces, a keel portion establishing a longitudinal keel line formed between and connecting the two gliding surfaces in the V-shaped array formed by said two gliding surfaces configured with a bow portion extending upwardly from the keel line to extend substantially above the water surface when the watercraft is gliding on one of the gliding surfaces, and means disposing the two gliding surfaces to diverge backwardly from the bow portion.

2. The watercraft defined in claim 1 wherein the divergence angle between the two gliding surfaces is between 5 and 22 degrees.

3. The watercraft defined in claim 1 wherein the V-shaped array of the two gliding surfaces is provided by an angle between the two gliding surfaces extending upward away from the water is between 110 degrees and 160 degrees.

4. The watercraft defined in claim 1 further comprising a stern portion along the longitudinal keel line extending between and connecting the two gliding surfaces, and disposing the stern portion to extend upwardly from the keel line between the two gliding surfaces.

5. The watercraft defined in claim 4 having a predetermined length of keel line for meeting the water surface, wherein the stern portion and two gliding surfaces meet along the keel line at a distance from the watercraft stern of between 6% and 35% of the length of the keel line.

6. The watercraft defined in claim 1 wherein each of the two gliding surfaces has a central axis, further comprising:

a hull constructed to sustain a weight of a crew member near the outer region of one gliding surface when the watercraft is gliding on the gliding surface of the remaining gliding surface with an effective lever arm extending from the outer region of one of the two gliding surfaces to the central axis of the other of the two gliding surfaces.

7. A watercraft, comprising in combination:

two gliding surfaces for gliding over a water surface arranged in a V-shaped array on either side of a longitudinal keel line, each gliding surface being configured to support the watercraft for gliding on the water surface substantially by the sole support of a single one of the gliding surfaces, and a keel portion establishing a longitudinal keel line formed between and connecting the two gliding surfaces in the V-shaped array formed by said two gliding surfaces configured with a bow portion extending upwardly from the keel line to extend substantially above the water surface when the watercraft is gliding on one of the gliding surfaces, and a leeboard arranged to extend downwardly from each of the two gliding surfaces.

8. The watercraft defined in claim 7 wherein each of the two gliding surfaces has a central axis, and wherein the leeboards are positioned between the keel line and the central axis of the respective gliding surfaces.

* * * * *